US010492004B2

(12) United States Patent
Goossens

(10) Patent No.: US 10,492,004 B2
(45) Date of Patent: Nov. 26, 2019

(54) AUDIO SYSTEM

(71) Applicant: PSS BELGIUM NV, Dendermonde (BE)

(72) Inventor: Jan Goossens, Dendermonde (BE)

(73) Assignee: PSS BELGIUM NV, Dendermonde (BE)

( * ) Notice: Subject to any disclaimer, the term of this patent is extended or adjusted under 35 U.S.C. 154(b) by 0 days.

(21) Appl. No.: 15/749,215

(22) PCT Filed: Jun. 9, 2016

(86) PCT No.: PCT/EP2016/063194
§ 371 (c)(1),
(2) Date: Jan. 31, 2018

(87) PCT Pub. No.: WO2017/021036
PCT Pub. Date: Feb. 9, 2017

(65) Prior Publication Data

US 2018/0227672 A1 Aug. 9, 2018

(30) Foreign Application Priority Data

Jul. 31, 2015 (GB) ..... 1513555.1

(51) Int. Cl.
*H04R 7/20* (2006.01)
*F01N 1/06* (2006.01)

(52) U.S. Cl.
CPC ..... *H04R 7/20* (2013.01); *F01N 1/065* (2013.01); *H04R 2307/025* (2013.01); *H04R 2307/029* (2013.01); *H04R 2307/204* (2013.01); *H04R 2499/13* (2013.01)

(58) Field of Classification Search
CPC ..... H04R 1/025
USPC ... 381/71.4, 86, 59, 300, 302, 332, 365, 397
See application file for complete search history.

(56) References Cited

U.S. PATENT DOCUMENTS

| | | | | |
|---|---|---|---|---|
| 4,112,168 | A | 9/1978 | Schafft | |
| 4,821,330 | A | 4/1989 | Pfleiderer | |
| 5,581,624 | A | 12/1996 | Geisenberger et al. | |
| 5,699,439 | A | 12/1997 | Geisenberger et al. | |
| 2006/0182302 | A1* | 8/2006 | Onodera | H04R 9/043 381/397 |

(Continued)

FOREIGN PATENT DOCUMENTS

| | | | |
|---|---|---|---|
| EP | 0656738 | A1 | 6/1995 |
| EP | 0669784 | A2 | 8/1995 |

(Continued)

OTHER PUBLICATIONS

Joshua R. Kelley: "An Advanced Alternative to Etylene Acrylic (AEM) Elastomers for High-Temperature, Oil Resistant Hoses", 14th Brazilian Congress of Rubber Technology of ABTB, Apr. 11-12, 2012, available from hittp://www.hytempacm.com/downloads/HyTemp_AR212XP.pdf.

(Continued)

*Primary Examiner* — Yosef K Laekemariam
(74) *Attorney, Agent, or Firm* — NK Patent Law

(57) ABSTRACT

Speakers for locating in a vehicle exhaust system having a speaker surround that is formed from a rubber compounded using a polyacrylate polymer. Speakers having a speaker surround that is integral with a coating that covers or substantially covers at least one surface of the diaphragm.

14 Claims, 5 Drawing Sheets

(56) References Cited

U.S. PATENT DOCUMENTS

| | | | | |
|---|---|---|---|---|
| 2013/0202148 | A1 | 8/2013 | Grupp et al. | |
| 2014/0328493 | A1 | 11/2014 | Wirth et al. | |
| 2015/0020762 | A1* | 1/2015 | Peitz | H04R 1/00 123/184.53 |
| 2015/0141557 | A1 | 5/2015 | Chen et al. | |

FOREIGN PATENT DOCUMENTS

| | | | | |
|---|---|---|---|---|
| EP | 1378539 | A1 | 1/2004 | |
| GB | 2315185 | * | 4/1997 | H04R 7/20 |
| GB | 2315185 | A | 1/1998 | |
| JP | 2013127035 | A | 6/2013 | |

OTHER PUBLICATIONS

Anonymous: "Acrylate polymer—Wikipedia, the free encyclopedia", Nov. 28, 2014, available from https://en.wikipedia.org/wiki/Acrylate_polymer.

UKIPO, Search Report of United Kingdom Patent Application No. GB1513555.1, dated Oct. 19, 2015.

ISA/EP, International Search Report and Written Opinion of PCT Patent Application No. PCT/EP2016/063194, dated Aug. 24, 2016.

* cited by examiner

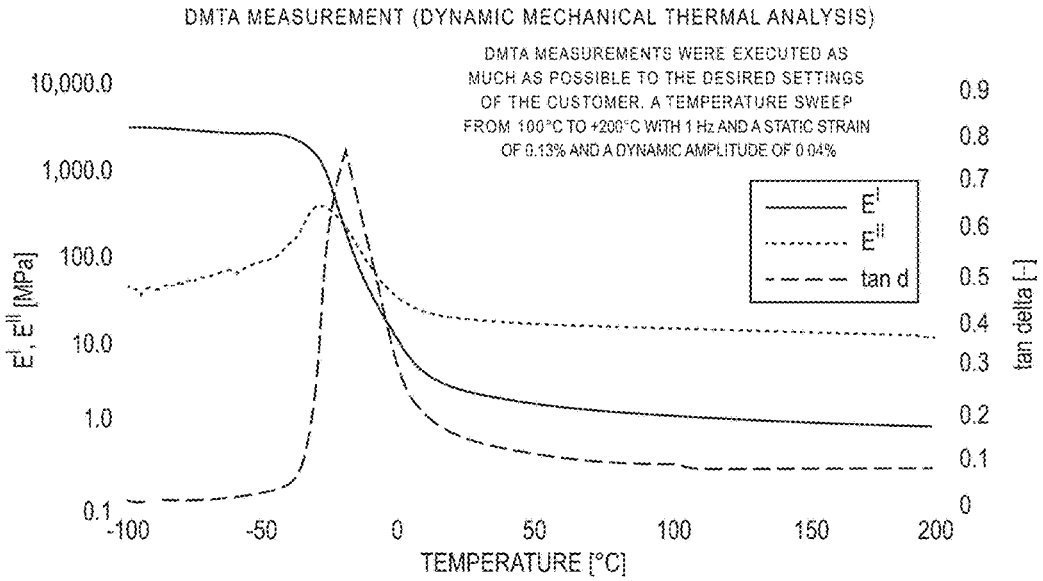

FIG. 5

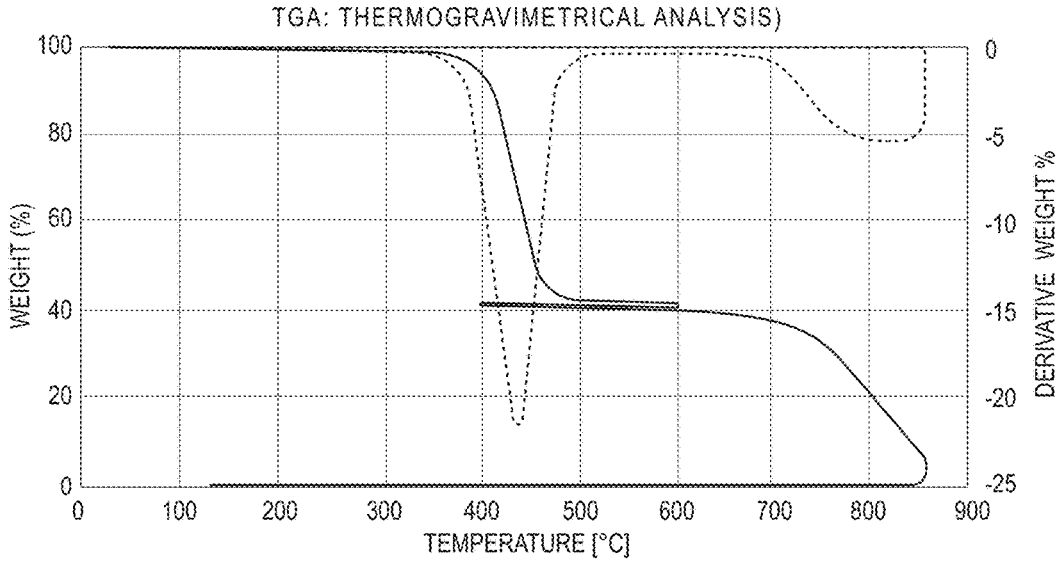

THERMOGRAVIMETRIC ANALYSIS (TGA) WAS PERFORMED ON A PERKIN ELMER BASED ON A CUSTOMER SUPPLIED PROTOCOL. IN THE TGA PROTOCOL THE TEMPERATURE IS FIRST RAISED FROM 40°C TO 600°C WITH 20C/MIN IN N, AFTER WHICH THE MATERIAL WAS COOLED IN N TO 450°C WITH -20C/MIN AND HELD CONSTANT FOR 2 MINUTES AT 450°C. THE NEXT STEP WAS A TEMPERATURE RISE IN AIR FROM 450°C TO 850°C WITH 20C/MIN AFTER WHICH THE TEMPERATURE WAS HELD CONSTANT AT 850°C FOR 20 MIN IN AIR. THE LAST STEP WAS THE COOLING DOWN OF THE SAMPLE IN N TO 40°C WITH +20C/MIN IN THE PROTOCOL A GAS FLOW WAS KEPT AT 200 ML/MIN AND INITIAL SAMPLE WEIGHT WAS BETWEEN 9 AND 11 MG.

FIG. 6

AUDIO SYSTEM

CROSS REFERENCE TO RELATED APPLICATION (S)

This application is a 371 National Phase Application of PCT Patent Application No. PCT/EP2016/063194 file don Jun. 9, 2016 which claims priority benefit of GB Patent Application No. 1513555.1 filed on Jul. 31, 2015, which herein incorporated by reference in their entirety.

FIELD OF THE INVENTION

The present invention relates to an audio system, in particular to an audio system for use in a vehicle exhaust, and to speakers for use in said audio systems.

BACKGROUND

It may be desirable to attach an audio system to a vehicle exhaust. This audio system may be directed at two main goals. A first is so-called engine harmonics addition (ASD). In other words, the speaker may generate noise so as to change or amplify the "revving" and/or running sounds of an engine. This can be useful for amplifying quiet engines, enabling them to be heard, and for improving the sound of an engine to provide, for example, a desirable v8 roar. A second is so-called engine harmonics cancellation, which may also be termed active noise cancellation (ANC). In this latter case, the audio system generates anti-sound, thereby reducing the noise associated the revving and running of the engine.

However, the inside of an exhaust experiences high temperatures during running of the vehicle. In diesel engines, the front of speaker may experience temperatures at high as 140° C., while in petrol engines this may be as high as 160° C. These elevated temperatures can be maintained for long periods, for example, during long journeys. In addition, speakers themselves generate heat. Exhaust interiors also undergo repeated heating and cooling, as vehicles are used and then parked, used and then parked repeatedly over their lifetime. In cold climates, cool temperatures may be well below freezing for long periods in winter months.

Furthermore, the interior of a vehicle exhaust system is subjected to a cocktail of assorted gaseous byproducts and particulates, including incompletely combusted hydrocarbons, carbon monoxide, carbon dioxide, nitrogen oxides and sulfur compounds. These are often incompatible with and/or harmful to audio system components.

These extreme conditions limit the use of audio systems to alter car exhaust sounds. In particular, the current designs for loud speakers are unable to withstand the conditions within the exhaust system. As a consequence, audio systems for vehicle exhausts are located outside the exhaust interior, for example attached to the outside of the exhaust pipe.

US2013/0202148 describes a muffler for an exhaust system. It is mounted in a housing on the exterior of the exhaust system, and the sound is allegedly transmitted and radiated into the exhaust stream via a connecting pipe.

A similar arrangement is described in US2014/0328493.

SUMMARY

The present invention is based on the applicant's insight that through use of a suitable speaker surround, speakers may be placed in vehicle exhaust interiors. Specifically, the inventor has found that use of a high temperature rubber speaker surround permits speakers to be located proximal or within the exhaust gas flow, improving the performance of audio systems for use with vehicle exhausts (as the sound is generated within the gas stream, rather than remotely). Speakers may be located within the vehicle exhaust flow, or adjacent to the flow without the need for the protective flow restrictions (communicating pipes) used at present. Conventional rubbers are not suitable for use as speaker surrounds in vehicle exhausts because they are unable to withstand the extreme temperatures, while conventional high temperature speakers are based on metal soldered components and are not gas tight (see, for example, U.S. Pat. Nos. 5,581,624 A and 5,699,439).

In a first aspect, the present invention provides a speaker for locating in a vehicle exhaust system, the speaker including a basket housing a voice coil and a spider and including a diaphragm, the diaphragm being affixed to the basket by a speaker surround, characterised in that the speaker surround is formed from a rubber compounded using a polyacrylate polymer. In other words, the rubber composition is based on a polyacrylate rubber, which is also referred to as an ACM rubber.

Suitably, the diaphragm is made from an aramid fiber material. Diaphragms made from these materials have been found to withstand the extreme temperature cycles experienced in a vehicle exhaust. The diaphragm may also be made from a fibrous glass material (fiber glass).

It will be appreciated that, given the location of the speaker, gas tightness is important. Suitably, the material is provided with a coating for gas tightness, for example, and not by way of limitation, the material may be coated with a polyester type of coating based on acrylic polyol and (iso) cyanate hardening agent.

It will be appreciated that good adhesion between the speaker surround and diaphragm is very important in these applications. The inventor has surprisingly found that the speaker surround of the invention provides excellent adhesion between the speaker surround and cone material. Advantageously, the inventor has found that the speaker surround of the invention is compatible with certain adhesives suitable for high temperature use.

The inventor has observed that both the issue of gas tightness and the importance of a durable and robust connection between the surround and diaphragm may be efficiently achieved through use of overmolding, as described herein. In other words, the speaker surround may be concomitantly formed and attached to the diaphragm using an overmolding technique.

In brief, using this overmolding process both forms the surround and coats all or substantially all of at least one surface (inner or outer surface) of the diaphragm with the rubber. Suitably the diaphragm is formed of a fibrous material, for example, aramid fibre or glass fibre. Without wishing to be bound to any particular theory, the inventor believes that the rubber, during the overmolding process, penetrates the fibres of the diaphragm, This provides excellent adhesion between the surround and the diaphragm, which the inventor has observed is able to withstand the challenging conditions experienced by the speaker in, for example, a vehicle exhaust gas flow.

Furthermore, the rubber coating of the diaphragm has been found to reduce or even prevent gas permeability. In other words, the rubber coating obviates the need for a separate gas tight coating to be applied.

The surround assembly and consequently the moving mass of the loudspeaker produced using this overmolding technique may also be lighter (~5 g lighter on a 6.5"

assembly") than speakers produced by the adhesive method described herein. This is because, at least, no adhesive is needed. The rubber coating on the diaphragm portion may also be lighter than other gas tight coatings likely to be applied.

Speakers produced using this overmolding technique are also more cost and time efficient. This is because the production process may involve fewer steps and materials. For example, as the rubber coating obviates the need to apply a separate gas tight coating, the steps of applying said coating and waiting for it to dry are avoided.

Furthermore, owing to the excellent adhesion, the application of a primer (to assist adhesion between the diaphragm and surround) and the step of waiting for the primer to dry can be avoided without sacrificing speaker integrity and longevity.

These advantages when combined may halve the production cost per unit.

Accordingly, in some embodiments, the speaker surround is integral with a coating that covers or substantially covers at least one surface of the diaphragm. As described herein, both the surround and coating are therefore formed from a rubber compounded using a polyacrylate polymer. Substantially covers refers to at least 75% by area of at least one surface, more preferably at least 80%, more preferably at least 85%, more preferably at least 90%, more preferably at least 95%.

The other side of the diaphragm may also be at least partially coated, for example by a rubber flow along the surface during molding, or through penetration (strike through) of the rubber through the fibres. Preferably, only one face is covered or substantially covered, although speakers in which both faces of the diaphragm are covered are within the scope of the invention.

Preferably, when the speaker is assembled, the entire exposed surface of the diaphragm is coated. The uncoated portion is suitably covered by a dust cap. In other words, the speaker may further comprise a dust cap, wherein the dust cap conceals a portion of the diaphragm, wherein the concealed portion is substantially free of rubber coating.

The inventor has observed that it is advantageous, in speakers having a separate dust cap, for the portion of diaphragm covered by the dust cap to be uncoated. This assists the assembly of the final speaker, as the inner diameter of the diaphragm (cone) can be accurately sized to fit over the coil without the need to estimate the extent to which rubber overflow may alter the diameter.

It will be appreciated that the overmolding process described herein also permits the concomitant molding of a dust cap. Accordingly, in some embodiments the speaker further comprises a dust cap, wherein the dust cap is integral with the coating that covers or substantially covers at least one surface of the diaphragm and is integral with the speaker surround.

It will be appreciated that dust caps are not typically used when the diaphragm of a speaker is flat, for example in flat panel loudspeakers. Accordingly, in some cases, the speaker does not have a dust cap and at least one surface of the diaphragm is covered by a coating of rubber compounded using a polyacrylate polymer, wherein the coating is integral with the speaker surround. In some cases, the diaphragm of the speaker is flat and is covered by a coating of rubber compounded using a polyacrylate polymer, wherein the coating is integral with the speaker surround.

In some cases, the dust cap of the speaker is integral with the diaphragm.

While overmolding is advantageous, other adhesion processes may be used. The speaker surround of the invention surprisingly shows excellent compatibility with certain adhesives based on epoxy resins. This affords a speaker having the desired stability for this application. This represents a significant advantage when compared to EPDM-based rubbers (which are often described as being suitable for high temperature applications) as these have been shown to have compatibility issues with these adhesives; this can lead to poor adhesion and therefore would lead to gas and particle ingress if used in a vehicle exhaust. Without wishing to be bound by any particular theory, the present inventor speculates that the poor performance of EPDM is connected to too low surface tension. Unlike EPDM, the polyacrylate rubbers of the invention have acrylate groups along the polymer background that the inventor believes helps with adhesion.

Accordingly, in some embodiments, the speaker surround is glued to the basket using an epoxy resin. In other words, an epoxy adhesive is used. In some embodiments, the speaker surround is glued to the diaphragm using an epoxy adhesive. Epoxy adhesives are known in the art.

The or each epoxy adhesive may suitably be a heat curing epoxy adhesive, for example a one-component heat curing epoxy adhesive. For example, the epoxy adhesive may be based on a bisphenol diglycidylether (such as bisphenol A diglycidylether), suitably having a molecular weight of ≤700. For example, the adhesive may be a one-part heat curing epoxy adhesive based on an oligomeric mixture of bisphenol A diglycidylether (molecular weight ≤700).

It will appreciated that an adhesive to join the diaphragm and speaker surround is not essential. For example, the diaphragm and surround may be joined using overmolding or insert (occasionally referred to as inset) molding techniques, which may be beneficial for efficiency during manufacture. For example, the rubber may be injection molded over the edge of the diaphragm so that the rubber cures into the diaphragm fibers (insert molding). The rubber may also be molded over the edge of the diaphragm using compression molding techniques. Combinations of insert and compression molding may also be used. Suitably, the edge of the diaphragm to be inset in the rubber is first coated with an adhesion promoter.

Suitably, the basket is made of a metal material, for example, a metal alloy such as steel. In some cases, the basket is stainless steel or e-coated steel.

As is conventional, the rubber of the speaker surround may be compounded with a filler, which may be one or more of carbon black, silica, and clay to suit. The filler may be present in an amount from 20 to 120 PHR (with respect to the ACM polymer). For example, the amount of filler may be 30 to 100 PHR, for example, 40 to 90 PHR, for example, 50 to 80 PHR. In some cases, it is around 65 PHR. Carbon black may be used alone. Carbon black may also be mixed with clay. This can reduce costs.

Suitably, the rubber undergoes less than a 20% change in E-modulus when the temperature is varied from 25° C. to 150° C.

Suitably, no weight loss in the rubber is detected in thermogravimetrical analysis at temperatures below 250° C.

As described herein, the speakers of the invention are for locating in a vehicle exhaust system. In a further aspect, the invention provides a vehicle exhaust system comprising a speaker as described herein.

The present invention further provides audio systems for generating sound in a vehicle exhaust, the audio system comprising a speaker according to the first aspect, a detector and a processor, wherein the detector is configured to detect engine noise and generate a first signal, the processor is configured to receive the signal and send a second signal to the speaker causing sound waves to be produced by the speaker.

The detector may be a microphone, or may electronically detect accelerator depression and/or engine activity.

In some embodiments, the microphone is located inside the vehicle exhaust.

The processor may be configured to determine the volume and frequency of sound to be produced, for example, by means of a computer program.

In some cases, the sound waves produced increase the volume of the noise coming from the exhaust. This may be termed ASD. In some cases, the sound waves produced decrease the volume of the noise coming from the exhaust. This may be termed ANC.

It will be appreciated that the sound waves may also moderate the apparent tone or pitch of the engine, for example, to produce a characteristic engine purr.

The overmolding process described herein is useful for speakers for locating in a vehicle exhaust system and other similarly high temperature applications. However, the advantageous gas tightness of the coating which is achieved efficiently and cost effectively has utility for other, non-high temperature, speaker applications. In other words, the invention further relates to a speaker including a basket housing a voice coil and a spider and including a diaphragm, the diaphragm being affixed to the basket by a speaker surround wherein the speaker surround is integral with a coating that covers or substantially covers at least one surface of the diaphragm.

Suitably, no adhesive is used to affix the diaphragm to the speaker surround; the integral nature of the surround and coating instead provides an effective connection.

It will be appreciated that for these non-high temperature applications, the use of compounded polyacrylate rubber is optional. Other thermoset rubbers, for example, NBR (nitrile butadiene), EPDM (ethylene propylene diene terpolymer), IIR (isobutylene isoprene rubber), PUR (polyurethane rubber), CSM (chlorosulfonated polyethylene), CPE (CM; chloropolyethylene), AEM (Ethylene acrylic rubber), ECO (epichlorohydrin) may be used. Thermoplastic Elastomers or vulcanisates including TPE (thermoplastic elastomer), TPV (thermoplastic vulcanizate), TPU (thermoplastic polyurethane), may also be used.

The inventor has found that such overmolded coatings, whether using compounded polyacrylate rubber or another material as described herein, make efficient use of material, providing only a relatively thin coating. Advantageously, only one face of the diaphragm is typically coated. In some cases, the coating is provided only to the front face of the diaphragm (although it will be appreciated that some strikethrough of the coating through the interstitial holes of the fibrous diaphragm material may result in some material forming on the reverse). In this context, front face refers to the outwards facing surface when the speaker is assembled.

Preferably, the thickness of the coating(s) is between 5 and 60% of the thickness of the diaphragm material. For example, suitably the thickness of the coating on the or each diaphragm face is less than 60% of the thickness of the cone material, for example less than 50%, less than 40%, less than 30%, less than 25%, less than 20%, less than 15%, or even as low as less than 10%. Where there is some variation in thickness, the values refers to a mean average.

In certain non-limiting embodiments, the speaker has a diaphragm of 0.3-0.4 mm thickness and the coating, applied to the front face of the cone only, is between 20 and 200 μm.

In a further aspect, the present invention provides use of a compounded polyacrylate rubber in a speaker.

It will be appreciated that the speakers and audio systems described herein are suitable for use in a vehicle exhaust. Naturally, they are not limited to use in vehicle exhausts and are suitable for other, similarly extreme temperature, locations.

The invention will now be described with reference to following drawings, in which:

FIG. 5 shows the DMTA of the ACM rubber used in the speaker surround of the present invention in a temperature sweep from −100° C. to +200° C. with 1 Hz frequency.

FIG. 6 shows the TGA of the ACM rubber used in the speaker surround of the present invention.

DETAILED DESCRIPTION

The following description is provided to illustrate the invention. It is not intended to limit the invention.

Figure 1:
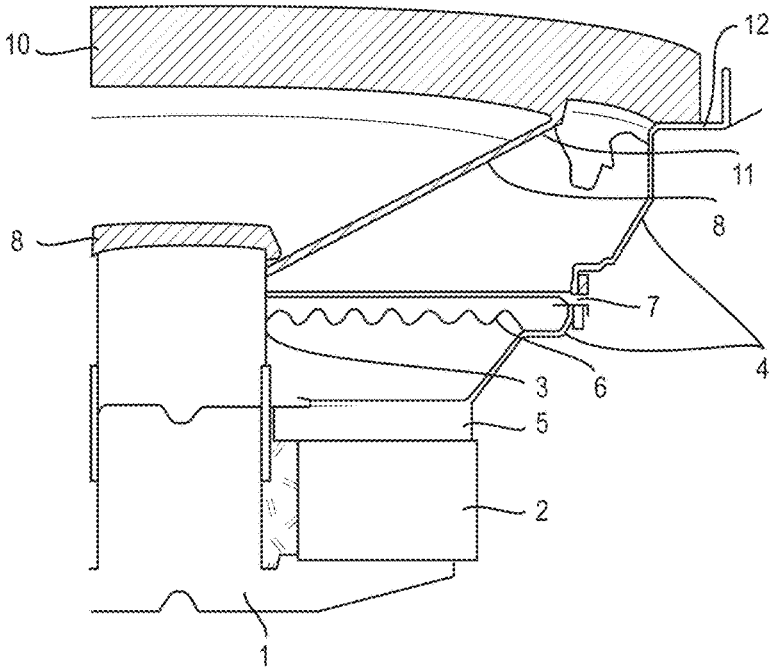
FIG. 1 shows a partial cut away speaker according to the invention.

The invention relates to a speaker, which may be as illustrated in FIG. 1. The speaker is suitable for using in vehicle exhaust systems, where it is exposed to high temperatures and extreme atmospheric conditions. The speaker depicted in FIG. 1 is a 100 W subwoofer and includes a yoke 1 (referred to as a U or T yoke) which is formed of e-coated steel. This supports a magnet 2 and a voice coil 3 which is formed of insulated aluminium (the insulation is provided by paper or aramid fiber material). The speaker has a metal basket 4 formed of e-coated steel which surrounds the voice coil 3. Between the speaker and magnet is a washer 5 of e-coated steel. The washer is glued to the yoke and magnet. Inside the basket 4 is a spider 6 formed of aramid fiber material and glued to the inner wall of the basket. A lead wire 7 is provided and attached to a connector plate with tags on the basket housing. The speaker has a diaphragm 8 (often referred to as a cone) over the opening of the basket, towards the "front" of the speaker. This is formed of aramid fiber material. The back of the cone is in contact with the voice coil 3 such that motive force generated by the voice coil is transmitted to the cone. The voice coil 3 is protected by a dust cap 9 of aramid fiber material to prevent ingress of exhaust fumes, condensates and particulates during use. The speaker has a speaker surround 10 around the circumference at the basket opening. This speaker surround is formed of a rubber compounded using a polyacrylate polymer. In other words, the rubber composition of the speaker is based on a polyacrylate polymer—the rubber is an ACM rubber. The cone is adhered to the speaker surround 10 at a location 11 around the entire circumference. The adhesion is achieved by a high temperature adhesive. The speaker surround is glued to the basket edge at a location 12 around the entire circumference.

In situ, the speaker is located in a vehicle exhaust system, with the front of the speaker directed into the engine emission stream. This typically includes exhaust fumes (such as $CO_x$, $NO_x$, $SO_x$), extremely acidic gasoline or diesel condensate and incompletely combusted hydrocarbons. The front of the speaker may therefore be expected to experience temperatures of 160° C. during use, while the back (magnet) portion may experience temperatures of 125° C. owing to the engine system, rising to 140° C. as the magnet operation itself may generate heat. During operation, the voice coil may generate up to 65° C. of heat, in addition to that experienced as a result of the vehicle operation.

The speaker may be controlled by a processor (not shown) which in turn receives information from a detector (not shown). The interfaces and connections between the detector, processor and speaker may be wired or wireless.

Of course, it will be appreciated that other appropriate speaker arrangements may be used, either as described herein or as is apparent to a person skilled in the art. For example, and not by way of limitation, the diaphragm 8 and speaker surround 10 may be inset molded together such that no adhesive is used. The speaker shown and described is circular, however, other appropriate shapes and arrangements may be envisaged. Except where specified otherwise, for example, in the claims, other suitable materials may be used. For example, stainless steel may replace e-coated steel.

Figure 2:
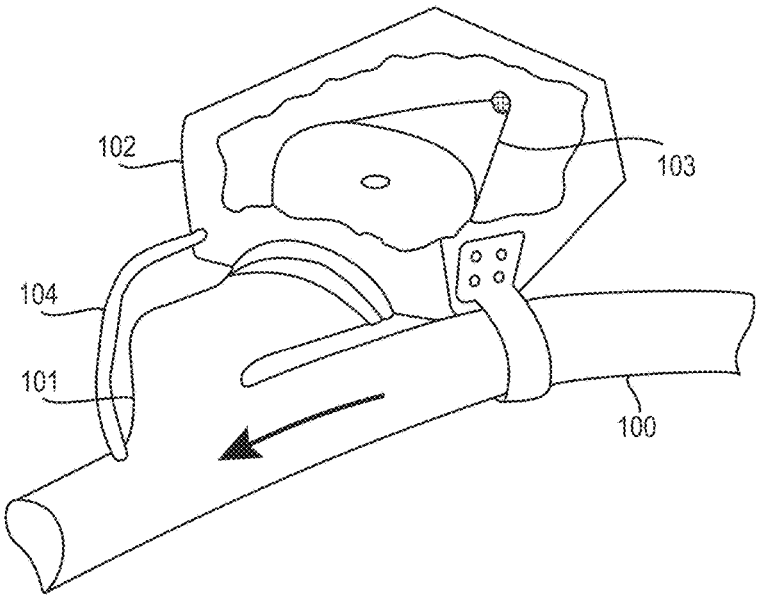
FIG. 2 shows a representative partially cut away drawing of the speaker in situ in an exhaust system.

The speaker of FIG. 1 is locatable in a vehicle exhaust system. Various locations and methods for installing a speaker arrangement in an exhaust system will be apparent to the skilled person. FIG. 2 shows a non-limiting possible arrangement. FIG. 2 a portion of a vehicle exhaust system comprising a pipe 100 through with exhaust gases flow. The pipe, and therefore exhaust gases, are in fluid communication via tube 101 with a speaker unit 102 housing a speaker 103 according to the invention. To assist pressure equalization, a pressing equalising tube 104 may be provided.

Of course, it will be appreciated that the speaker may be provided in a chamber in the exhaust system, with the exhaust gasses flowing through said chamber. Advantageously, there is no need to provide a filter to protect the speaker from the exhaust gasses.

Abbreviations

ACM-polyacrylate polymer
ANC-engine noise cancellation
ASD-engine harmonics addition
DMTA-dynamic mechanical thermal analysis
EPDM-ethylene propylene diene polymer
EPHR-chemical equivalents per hundred of rubber
PHR-parts per hundred of rubber
$T_g$-glass transition
TGA-thermogravimetrical analysis Definitions Aramid fiber material This describes a class of materials formed of strong, heat-resistant fibers. These fibers are produced by spinning solid fibers from a liquid chemical blend of aromatic polyamides.

For example, the aramid fiber material may comprise a para-aramid such as Kevlar® or a meta-aramid such as Nomex®.

Parts Per Hundred of Rubber

This is a commonly used way of describing the relative amounts of the various components in a compounded rubber. It refers to relative amounts of starting materials that are compounded with respect to the polymer used (the ratio of which is set to 100). In other words, 5 PHR of an ingredient means that 5 kg of this ingredient is added 100 kg of polymer.

Vulcanisation/Curing

This is the chemical process of cross-linking a rubber composition to provide a more durable material. Vulcanization is typically achieved with sulfur. For example, for high temperature rubbers such as EPDM rubbers, o-toluidines such as DOTG are commonly used. However, o-toluidines have recently been added to EU REACH candidate list of substances for very high concern for authorisation owing to their carcinogenic properties. Advantageously, the rubbers of the present invention are cured without the use of o-toluidines.

Rubber Compositions

The rubber of the speaker surround is compounded using an ACM polymer.

Polyacrylate polymer, also referred to as ACM polymer, is formed from a monomer composition comprising acrylic acid ester units. It may be formed from a monomer composition comprising only acrylic acid ester units. However, small amounts of monomers other than acrylic acid ester units may be present. Suitably, the composition comprises 90 to 99.9% by weight acrylic acid ester monomer units. Suitably, the composition comprises 60-90% by weight, optionally 70-90% by weight, for example, about 80% by weight alkyl acrylate monomers. Suitably, at least half of the alkyl monomer is ethyl acrylate monomer. Suitably, the ethyl acetate is copolymerised with other acrylate esters. Suitably, the composition may comprise 40 to 70% by weight ethyl acrylate, for example 50 to 60% by weight. A representative value is around 50% by weight ethyl acrylate. Suitable other acrylate esters include n-butyl acrylate and 2-methoxyethyl acrylate.

The composition may comprise 0.1 to 10% by weight at least one carboxyl group-containing ethylenically unsaturated monomer, for example mono-n-methyl maleate or mono-n-methyl fumarate, and/or a monomer comprising a reactive halogen such as vinyl chloroacetate. This may be referred to as a functionalised monomer. For example, the composition may comprise 1 to 5% by weight functionalised monomer. More than one functionalised monomer may be present. For example, a mixture of chloro and carboxyl groups may be present in the polymer.

In some embodiments, the ACM polymer is not a "dual cure-type" polymer (in other words, it is substantially free of carboxyl groups). In some embodiments, the composition does not comprise a monomer comprising a reactive halogen.

The polymer may be of the HT-ACM family, which is configured for amide crosslinking technology using curatives as described herein.

Suitable ACM polymers are known in the art, and may be manufactured according to known methods (for example, as described in EP1378539, which is incorporated by reference in its entirety) or purchased from commercial suppliers, for example Hy-Temp AR12® and Hy-Temp AR12B® from Zeon Chemicals®.

In the quantities described herein, all values are given in PHR with respect to 100 parts to this ACM polymer.

It will be appreciated that the rubber is compounded with additional ingredients, including a filler as described above. The following ingredients may be included in the compounding. It will be appreciated that ingredient combinations may be selected to complement each other and/or to behave synergistically.

The rubber of the speaker surround is compounded with an antioxidant. Any suitable antioxidant may be used, and such antioxidants are known in the art. Suitably, the antioxidant is present in an amount from 0.5 to 5 PHR, for example, from 1 to 5 PHR. A representative value is around 3.5 PHR.

The antioxidant may be a diphenyl amine, for example 4,4'-bis (alpha, alpha-dimethylbenzyl) diphenylamine. This is available commercially as Naugard® 445 from Chemtura®.

More than one antioxidant may be present. For example, an imidazole may be used. Imidazoles have well-known corrosion inhibitor properties. The imidazole may be a benzimidazole, for example an alkyl mercaptobenzimidazole. A suitable further antioxidant is methylmercaptobenzimidazole, available commercially as Rhenogran® MMBI-70 from RheinChemie Additives®. For example, a diphenylamine antioxidant and a mercaptobenzimidazole antioxidant may be used in a ratio of approximately 4:3.

The inventor has found that methylmercaptobenzimidazole is a particularly suitable anti-oxidant and it retains its properties and does not interfere in the ACM curing and vulcanising processes. Without wishing to be bound by any particular theory, the inventor attributes this to the absence of metal cations, and in particular, zinc (ZMBI—zinc mercaptobenzimidazole is commonly used in the art).

The rubber of the speaker surround is compounded with stearic acid, as is known in the art. Stearic acid may help to dissolve the curatives. The stearic acid may be present in an amount from 0.5 to 3 PHR, for example, around 1 PHR.

Processing aids are normally included to improve the handling of the rubber during compounding and molding. Suitable processing aids are known in the art. The total amount of processing aids may be up to about 10 PHR, for example up to about 6 PHR. For example, the total amount of processing aids may be 0.5 to 6 PHR.

More than one processing aid may be used. For example, a processing aid may be added to improve mold release and a processing aid added to improve the mixing and compounding of the rubber product. By way of example, and not by way of limitation, long chain (for example $C_{15-25}$) primary alkyl amines may be used such as octadecyl amine. This is available commercially as Ofalub® STA available from ChemSpec Ltd® and Armeen® 18D from AkzoNobel®. By way of example, and not by way of limitation phosphoric acid esters of modified fatty alcohols may be used such as commercially available Ofalub® SEO available from ChemSpec Ltd®.

Plasticizers can be used to improve processing of the compounded rubber. These plasticizers also transfer beneficial properties to the cold flexibility of the compounded rubber. By way of example, and not by way of limitation, a, plasticizer like TOTM (Trioctyl Trimellitate) may be used to improve the molding process.

Importantly, as described herein, a sulfur vulcanisation is not used. This is advantageous as it avoids the use of hazardous o-toluidene reagents. Rather, suitable curing can be achieved using appropriate curatives. Suitably, the rubber of the speaker surround is compounded with a carbamate. This may be present in an amount from 0.1 to 6 PHR. More than one carbamate may be present. Suitably, the carbamate is a carbamate of an α,ω-diaminealkane, for example hexamethylene diamine carbamate. Hexamethylene diamine carbamate is commercially available as A representative amount range for this α,ω-diaminealkane carbamate is 0.1 to 2 PHR. Without wishing to be bound to any particular theory, it is thought that the carbamate generates an α,ω-diamide cross-link between two polymer backbones of the ACM polymer (for example, through ester to amide nucleophilic amide substitution). Further curing its thought to cause these diamide cross-linkers to react with adjacent ester moieties on the polymeric backbones, leading to dehydration and imide formation.

Commercially available combinations of activated amines may be used in the curing process. Again without wishing to be bound to any particular theory, it is thought that these activated amines assist with amide/imide bond formation by generating leaving groups. This composition comprising activated amines may be present in an amount from 1 to 4 PHR, for example, a representative amount is around 2 PHR. A commercially available example is Rhenogran® XLA-60 (GE2014), available from Lanxess®.

As described above, the curing process suitably uses amide crosslinking technology. Suitably, the curing process involves the formation of carbon-nitrogen bonds. Suitably, after curing the rubber comprises cross-linked portions comprising amide and/or imide bonds. Preferably, imide bonds are present.

It will be appreciated that the present invention further relates to a rubber as described herein.

It will be appreciated that relative amounts of many of these ingredients may be varied. A representative compounding formulation is shown below:

| Chemical | Min | Max |
|---|---|---|
| ACM (polyacrylate rubber) polymer | 100.00 | 100.00 |
| Carbon black | 0.00* | 120.00 |
| Silica | 0.00* | 60.00 |
| Clay | 0.00* | 50.00 |
| A diphenylamine such as 4,4'-Bis (α,α-dimethylbenzyl) diphenylamine (Antioxidant) | 0.50 | 4.00 |
| Stearic acid | 0.50 | 3.00 |
| Octadecyl amine (process aid) | 0.25 | 3.00 |
| Phosphoric acid ester of modified fatty alcohol (process aid) | 0.25 | 3.00 |
| Combination of activated amines | 1.00 | 4.00 |
| Hexamethylene Diamine Carbamate | 0.10 | 2.00 |
| Methylmercaptobenzimidazole (antioxidant) | | 3.00 |

*Typically one or more of these filler will be present, that is there will be at least 20 PHR of carbon black, silica and/or clay.

It will be appreciated that the rubber may be compounded with additional ingredients such as plasticizers and dyes (if silica is used as filler for example).

For example, TOTM (Min 0.50; Max 5.00) may preferably be added to the above composition.

EXAMPLE 1

Example Rubber Composition

The following is a representative rubber composition according to the present invention. It is referred to as Example 1.

| Chemical | Trade name of example | Amount |
|---|---|---|
| ACM (polyacrylate rubber) polymer | HyTemp AR12B | 100.00 |
| Carbon black | | 65.00 |
| Antioxidant (diphenylamine) | Naugard 445* | 2.00 |
| Stearic acid | | 1.00 |

-continued

| Chemical | Trade name of example | Amount |
|---|---|---|
| Octadecyl amine | Ofalub STA Armeen 18D | 1.00 |
| Phosphoric acid ester of modified fatty alcohol | Ofalub SEO | 1.00 |
| Combination of activated amines | Rhenogran XLA-60 | 2.00 |
| Hexamethylene Diamine Carbamate | Diak-1 | 0.60 |
| Antioxidant methylmercaptobenzimidazole | Rhenogran MMBI-70 | 1.43 |

*(4,4'-bis (alpha, alpha-dimethylbenzyl) diphenylamine)

As elsewhere, all values mentioned are parts per hundred of rubber (PHR) with respect to a ratio of 100 parts of polymer (ACM).

The rubber was compounded using conventional rubber mixing equipment using techniques well established in the art. Where appropriate, processing to provide the rubber edge (surround) was achieved by injection molding or via thermoforming (compression moulding). These techniques are known in the art.

Comparison EPDM Rubber Composition

A comparison rubber speaker surround was prepared using the following EPDM-based formulation:

| Chemical | Trade name/Abbreviation | Amount |
|---|---|---|
| EPDM polymer | JSR/EP33 | 100 |
| carbon black | N550 | 15 |
| carbon black | N774 | 10 |
| calcium carbonate | CACO3 | 20 |
| clay | KA0LINE | 30 |
| silica | 1106 | 15 |
| plasticizer | ATBC | 10 |
| stearic acid | ST | 1.5 |
| curative | TBZTD | 0.5 |
| curative | EZ | 0.6 |
| zinc oxide | ZNO | 5 |
| sulfur | S | 1.5 |
| antioxidant | RD | 1.5 |

Tensile Strength

The rubbers of the invention show excellent retention of tensile strength over a wide temperature range. Indeed, as can be seen from FIG. 2, the tensile strength hardly changes over a 125° C. window. This provides excellent mechanical stability and integrity for the applications of interest. By contrast, a compassion EPDM-based rubber marketed for high temperature use shows marked variation in tensile strength over the temperature range.

Figure 3:
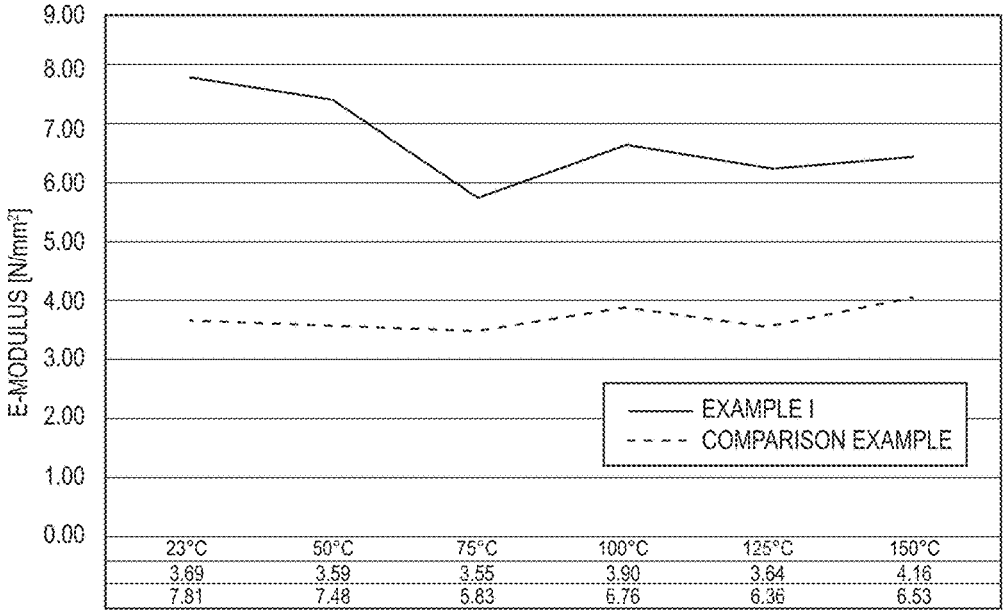
FIG. 3 shows the variation in tensile strength of the ACM rubber used in the speaker surround of the present invention and a comparison EPDM-based rubber.

The tensile strength of the rubbers of the invention are also stable after prolonged exposure to high temperature. FIG. 3 shows the changes in E-modulus, tensile strength and elongation after heat exposure at various temperatures for various durations. Importantly, the tensile strength is virtually unchanged, even after 96 h at 170° C.

Thermal Analysis

Figure 4:
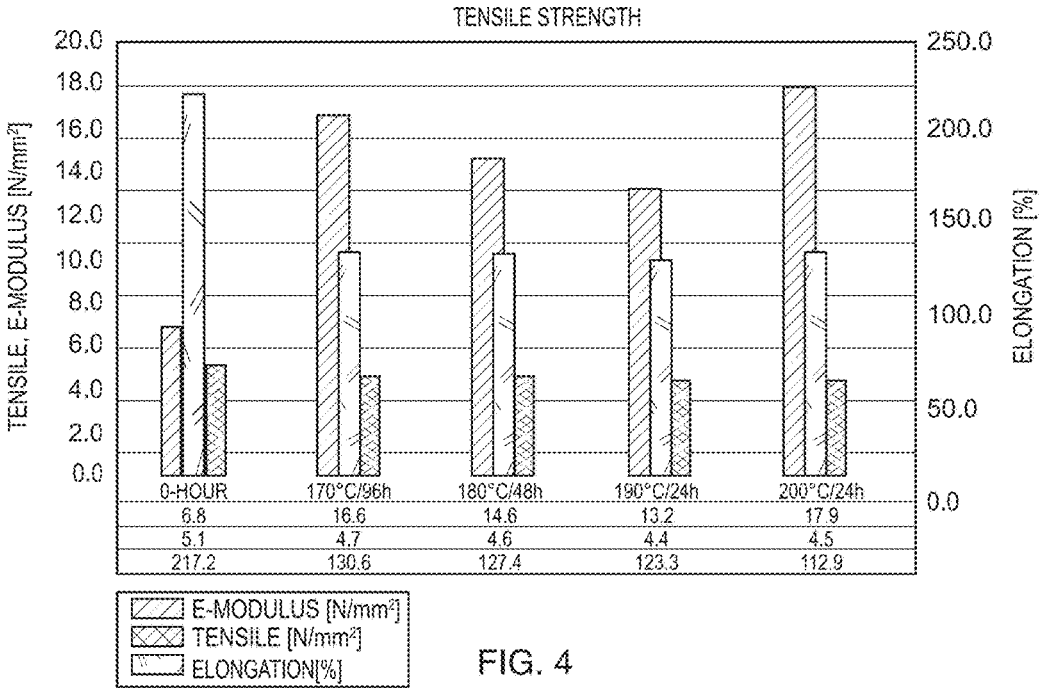
FIG. 4 shows changes in E-modulus, tensile strength and elongation after heat exposure at various temperatures for various durations.
Figure 7:
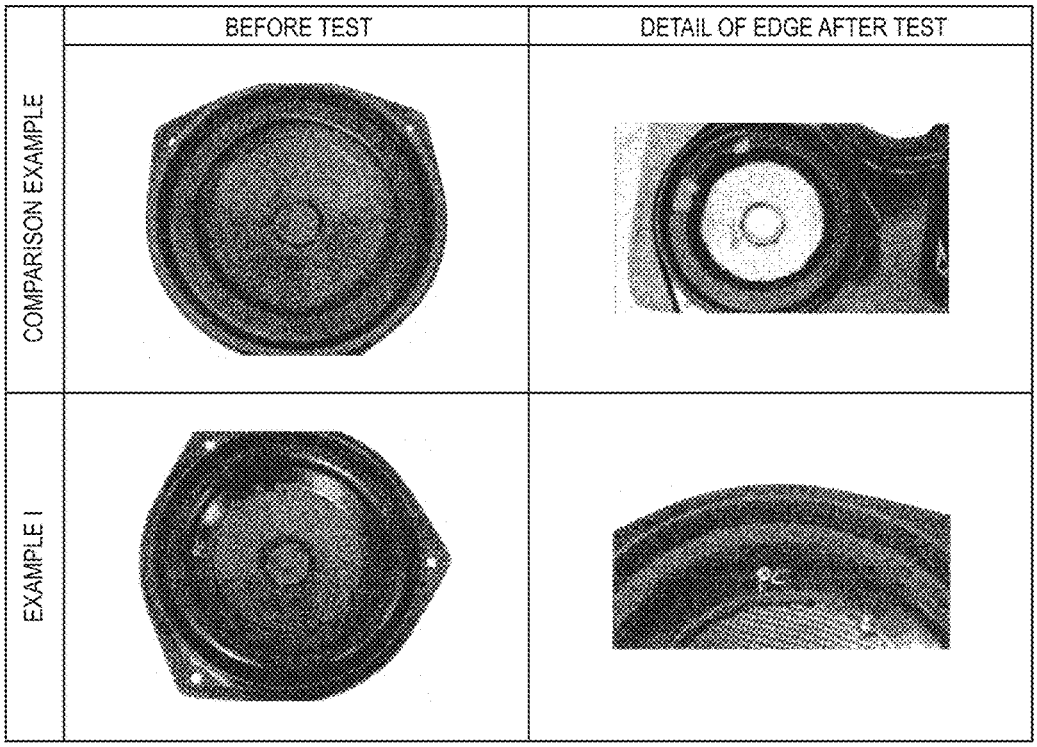
FIG. 7 shows a speaker according the invention and a comparator speaker after a high power capacity handling test at 160° C.

FIG. 4 shows the DMTA of the rubber of example 1 in a temperature sweep from −100° C. to +200° C. with 1 Hz frequency: static strain was set at 0.13% and dynamic amplitude was 0.04%. The glass transition area is between −35° C. and +15° C.; with a $T_g$ (glass transition) of around −10° C. This is measured in shear and is not representative for actual $T_g$. Actual $T_g$ can be determined by DSC and is typically some 15° C. lower than on DMTA.

FIG. 5 shows the TGA of the rubber of example 1. The temperature was increased from 40° C. to 600° C. at 20° C./min under an $N_2$ inert atmosphere. The temperature was cooled to 450° C. at 20° C./min; then the gas supply switched to an $O_2$ atmosphere, and the temperature increased at 20° C./min up to 850° C.

As is clear from the curve, there is no ash content (no inorganic fillers were used). The first weight loss appeared only around 300° C. This is very high and shows stable performance for this temperature range.

Structural Integrity of Speaker Surrounds

The rubber of example 1 was tested as a molded speaker surround and compared to a conventional EPDM based surround in a high power capacity handling test. A sinusoidal wave of 45 Hz was put on the speaker with a power of 7.5V (free air). These tests were performed at different temperatures. The comparison speakers fail at 160° C.: the rubber edge is completely scattered. Speakers of the invention have passed this test even at 180° C. (higher temperatures are now being tested and initial results are promising).

FIG. 6 shows the speakers before and after the test performed at 160° C.

Advantageous Properties

The rubber of example 1 has been shown to:

i. Maintain dynamic behaviour over the entire temperature range of interest (−40° C. to +200° C.). Early results suggest that this upper limit is much higher.

ii. Provide adhesion to the cone material.

iii. Satisfy requirements for use in a vehicle exhaust (ability to withstand exhaust fumes, gas impermeability etc)

iv. Be compatible with suitable high temperature resistant adhesives

Advantageously, the rubbers of the invention are compounded entirely sulfur free, meaning that o-toulidines are not used. As explained above, o-toulidines have recently been placed on the EU REACH candidate list of substances for very high concern for authorisation. The invention provides suitable rubbers for high temperature uses while avoiding the use of o-toulidines such as DOTG.

Integral Surround and Diaphragm Coating

As described herein, the inventor has found that it may be advantageous to use rubber as described herein to form both the speaker surround and to provide a coating to substantially all of at least one face of the diaphragm. This serves to improve the durability and longevity of the speaker as the connection of the surround and diaphragm is integral, and reduces both unit cost and weight (as fewer materials and process steps are used). The rubber may coat one or both faces of the diaphragm, and suitably partially or completely strikes through gaps between the fibres of the cone material. The inventor has found that the resultant speakers, once assembled, show desirable gas tightness without the need for a separate gas tightness layer or other gas tightness treatment step. In other words, suitably the speaker diaphragm is not treated with phenolic resin, acrylic polyol and (iso)cyanate hardening agent or similar.

Figure 8:
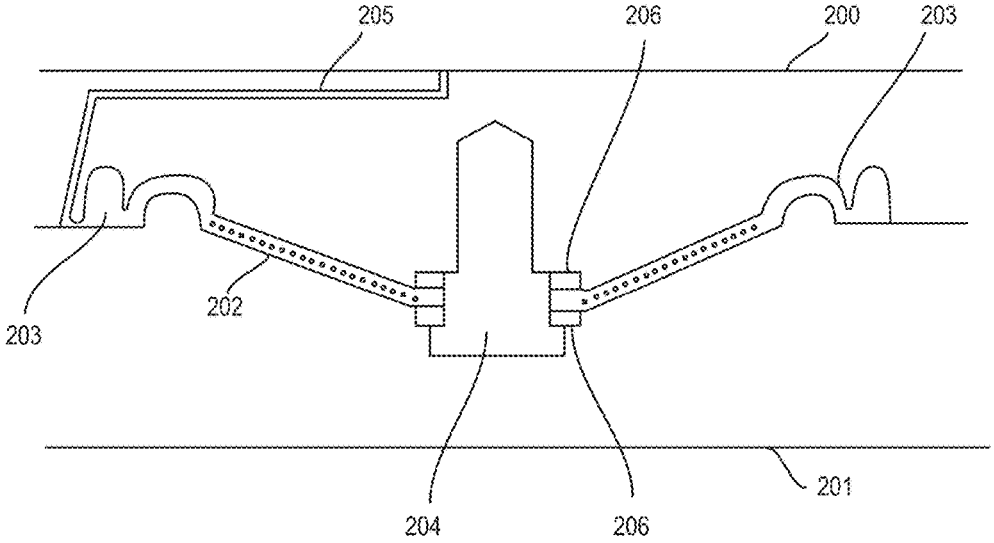
FIG. 8 shows an illustration of a mold that may be used to cast an integral surround and diaphragm coating as described herein.

A representative mold is shown in FIG. 8. The mold has an upper portion 200 and a lower portion 201. The upper and lower portions define a cavity 202. The diagram shows a cross section, and the cavity, for the purpose of this explanation, should be considered circular. Of course, as described herein, other speaker shapes are also envisaged. The diaphragm is placed in cavity 202 and is indicated by a dotted line. The cavity further comprises an annular 203 region into which the surround is cast. As shown, the diaphragm does not extend into the surround region, which may have a curve, as shown.

The diaphragm and mold cavity are centred on a centering portion 204 which ensures that the relevant pieces are in alignment when the rubber is molded. The upper and lower portions as shown are held together during the molding process by compression, although other means including bolts and clamps will be apparent to the skilled person.

As shown, the rubber is injected under pressure via conduit 205. Only one is shown, although typically there will be more than one spaced around the mold. The rubber may be introduced by injection molding processes, but other rubber molding processes may be used, for example thermoforming/compression molding in which thin strips of rubber are placed in the mold and cast through application of heat and/or pressure.

The neck portion of the cone is preferably protected by a seal, such that a small section of the cone at the neck (which is covered by the dust cap in the assembled speaker) is not overmolded. Keeping this section of the cone free of rubber coating improves adhesion of the cone neck to coil. The inventor has further observed that shielding the neck portion helps to prevent rubber pooling and collecting at the neck area.

The seals may be in the form of O-rings 206, and may be provided above and/or below the cone material. The inventor has observed that the use of square-cut O-rings may provide a more efficient seal against the diaphragm material. Suitable sealing materials may include, but are not limited to, Viton®, silicone, Teflon® NBR and steel.

After forming the integral surround and coating, preferably, the rubber is at least partially cured in the mold. This may prevent damage to the assembly when it is removed.

All optional features and preferences described herein are combinable to the extent that such a combination is not clearly excluded.

The invention claimed is:

1. A speaker for locating in a vehicle exhaust system, the speaker including a basket housing a voice coil and a spider and including a diaphragm, the diaphragm being affixed to the basket by a speaker surround, characterised in that the speaker surround is formed from a rubber compounded using a polyacrylate polymer and wherein the diaphragm is formed of a fibrous material, the speaker surround being integral with a coating that covers or substantially covers at least one surface of the diaphragm, and the speaker surround and coating being formed by use of an overmolding process.

2. The speaker of claim 1, wherein the diaphragm is formed of an aramid fibre material or fiberglass.

3. The speaker of claim 1, wherein the speaker further comprises a dust cap, wherein the dust cap conceals a portion of the diaphragm, wherein the concealed portion is substantially free of rubber coating.

4. The speaker of claim 1, wherein the speaker further comprises a dust cap, wherein the dust cap is integral with the coating that covers or substantially covers at least one surface of the diaphragm and is integral with the speaker surround.

5. The speaker of claim 1, wherein the speaker further comprises a dust cap which is integral with the diaphragm.

6. The speaker of claim 1, wherein the speaker surround is secured to the basket using a heat-cure epoxy adhesive.

7. The speaker of claim 1, wherein the rubber is compounded with an alkyl mercaptobenzimidazole, optionally wherein the rubber is compounded with methyl mercaptobenzimidazole.

8. The speaker of claim 1, wherein the rubber is compounded with both carbon black and clay.

9. An audio system for generating sound in a vehicle exhaust, the audio system comprising a speaker according to claim 1, a detector and a processor, wherein the detector is configured to detect engine noise and generate a first signal, the processor is configured to receive the signal and send a second signal to the speaker causing sound waves to be produced by the speaker.

10. A speaker including a basket housing a voice coil and a spider and including a diaphragm, the diaphragm being affixed to the basket by a speaker surround wherein the speaker surround is integral with a coating that covers or substantially covers at least one surface of the diaphragm the speaker surround and coating being formed by use of an overmolding process, and the diaphragm being formed of a fibrous material.

11. The speaker of claim 10, wherein the coating covers or substantially covers only one surface of the diaphragm.

12. The speaker of claim 10, wherein the coating thickness is 60% or less than the thickness of the diaphragm.

13. The speaker of claim 10, wherein the speaker further comprises a dust cap, wherein the dust cap is integral with the coating that covers or substantially covers at least one surface of the diaphragm and is integral with the speaker surround.

14. The speaker of claim 10, wherein the speaker further comprises a dust cap, wherein the dust cap is integral with the diaphragm.

* * * * *